US006359381B1

(12) United States Patent
Okuno et al.

(10) Patent No.: US 6,359,381 B1
(45) Date of Patent: Mar. 19, 2002

(54) LAMP AND PORTABLE LIGHTING DEVICE

(75) Inventors: Shigeyoshi Okuno; Morio Hashida; Hitoshi Kamitani, all of Kagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/271,501

(22) Filed: Mar. 18, 1999

(30) Foreign Application Priority Data

Dec. 9, 1998 (JP) ..... 10-349636

(51) Int. Cl.[7] ..... H01J 1/62; H01J 1/32
(52) U.S. Cl. ..... 313/485; 313/578; 313/483
(58) Field of Search ..... 313/485, 486, 313/487, 483, 110, 111, 113, 578, 315, 635, 484; 362/84

(56) References Cited

U.S. PATENT DOCUMENTS

| | | | | |
|---|---|---|---|---|
| 2,759,119 A | * | 8/1956 | Thorington | 313/483 |
| 4,528,621 A | * | 7/1985 | Hoyt | 362/189 |
| 4,546,416 A | * | 10/1985 | Pemberton | 362/84 |
| 5,041,758 A | * | 8/1991 | Huiskes et al. | 313/487 |
| 5,757,111 A | * | 5/1998 | Sato | 313/111 |
| 5,859,496 A | | 1/1999 | Murazaki et al. | |

FOREIGN PATENT DOCUMENTS

| | | |
|---|---|---|
| JP | 8-329897 | 12/1996 |
| JP | 3040839 | 6/1997 |

* cited by examiner

*Primary Examiner*—Nimeshkumar D. Patel
*Assistant Examiner*—Karabi Guharay
(74) *Attorney, Agent, or Firm*—Merchant & Gould

(57) ABSTRACT

A phosphorescent layer comprising a phosphorescent compound and a binder resin is provided at least on the front surface of a bulb in order to provide a lamp having phosphorescent layer with improved strength and durability and also an improved recognizability even after turning off the light. A portable lighting device having the lamp is also provided. A phosphorescent layer is applied to the front surface of a single-end bulb of a lamp in the range from ¼ to ½ of the bulb surface area. The phosphorescent layer mainly comprises strontium aluminate ($SrAl_2O_4$). This material is added to a solution dissolving a binder resin and mixed to provide a paint, and the paint is applied to a predetermined position of the lamp. For the application, the single-end bulb is dipped in the paint and dried to evaporate the solvent. The paint preferably comprises 1–50 weight parts of the binder resin to 100 weight parts of the phosphorescent compound.

6 Claims, 7 Drawing Sheets

| | Application position | No application | Top1/4 | Top1/2 | Bottom1/2 | Bottom1/4 | Full application |
|---|---|---|---|---|---|---|---|
| Light on | Luminous flux maintenance (%) | 100 | 95 | 90 | 91 | 97 | 75 |
| | Illuminance maintenance (%) | 100 | 93 | 75 | 35 | 90 | 7 |
| Light out | Front view of illuminating reflecting mirror □-Non-luminous part ▨-Luminous part | | | | | | |
| | Visibility order | - | 2 | 1 | 3 | 4 | - |

FIG. 6

LAMP AND PORTABLE LIGHTING DEVICE

FIELD OF THE INVENTION

This invention relates to a lamp used for a portable lighting device or the like, and also a portable lighting device including the same.

BACKGROUND OF THE INVENTION

Conventionally, a lamp used for a portable lighting device emits light only when electric power is supplied. The lamp positioned inside a reflecting mirror emits light as it is connected to a power source.

In such a conventional lamp and a lighting device including the same, however, the light goes out immediately when power supply stops. As a result, the environmental circumstance and position of the lighting device cannot be recognized easily, which may cause hazards. For example, when a bicycle with a headlight stops running, an oncoming person cannot be aware of the bicycle until colliding with it. Car drivers cannot see such a bicycle at an intersection, which may cause an accident. Or it is difficult to find a lighting device in an unexpected blackout. Also, since lamps are carried and assembled into sockets by hands, if phosphorescent layers are provided on the lamp, they should be difficult to peel off.

SUMMARY OF THE INVENTION

Tb solve the above-mentioned problems, this invention provides a lamp and a lighting device including the same, and the lamp of this invention comprises a phosphorescent layer that is difficult to peel off. The layer has a long-lasting phosphorescent property, and the luminescence of the lamp continues for a certain time after turning off the light.

In order to achieve the purpose, a lamp of this invention has a phosphorescent layer comprising a phosphorescent compound and a binder resin on at least the front surface of a bulb. Addition of the binder resin can improve the strength and durability of the phosphorescent layer. Preferably 1–50 weight parts of the binder resin is added to 100 weight parts of the phosphorescent compound. When the ratio of the binder resin is less than 1 weight part, the strength and durability of the phosphorescent layer will be decreased. When the binder resin exceeds 50 weight parts, the phosphorescent property will be decreased.

In the lamp, the thickness of the phosphorescent layer is preferably from 150 to 250mg/cm$^2$. Within this range, the illumination during regular lighting of the lamp will not be much decreased, while the phosphorescent layer will illuminate to be recognized even if the lamp is turned off.

In the lamp, the phosphorescent layer is preferably formed in the range from ¼ to ½ of the bulb surface area. When the phosphorescent layer is formed at least on the front of the bulb and covers in the range from ¼ to ½ of the surface area of the same bulb, the phosphorescent layer will illuminate to be recognized even if the lamp is turned off.

In the lamp, the phosphorescent pigment can be an inorganic material having a luminescent peak in the wavelength of about 350–700 nm. Light having wavelength of about 350–700 nm is included in visible light that can be recognized by human beings.

The phosphorescent pigment can comprise strontium aluminate ($SrAl_2O_4$) as the main component for cost reduction and convenience.

A portable lighting device of this invention is provided with a lamp as mentioned above inside (in front) of its reflecting mirror. The phosphorescent layer is coated on the part that is positioned forward when the lamp is in use, and the reflecting mirror of the lamp assembly is positioned behind the bulb.

The portable lighting device can be, for example, a flashlight, a headlight for a bicycle, or a head lamp.

BRIEF DESCRIPTION OF THE DRAWINGS

FIG. 5(*a*) illustrates the light paths and luminescence at lighting, while

FIG. 5(*b*) illustrates the same at turning off the light.

FIG. 6 illustrates a comparison of the luminous flux, illuminance maintenance and luminescence with various positions and ranges of the application of a phosphorescent pigment.

DETAILED DESCRIPTION OF THE PREFERRED EMBODIMENT

Figure 1:
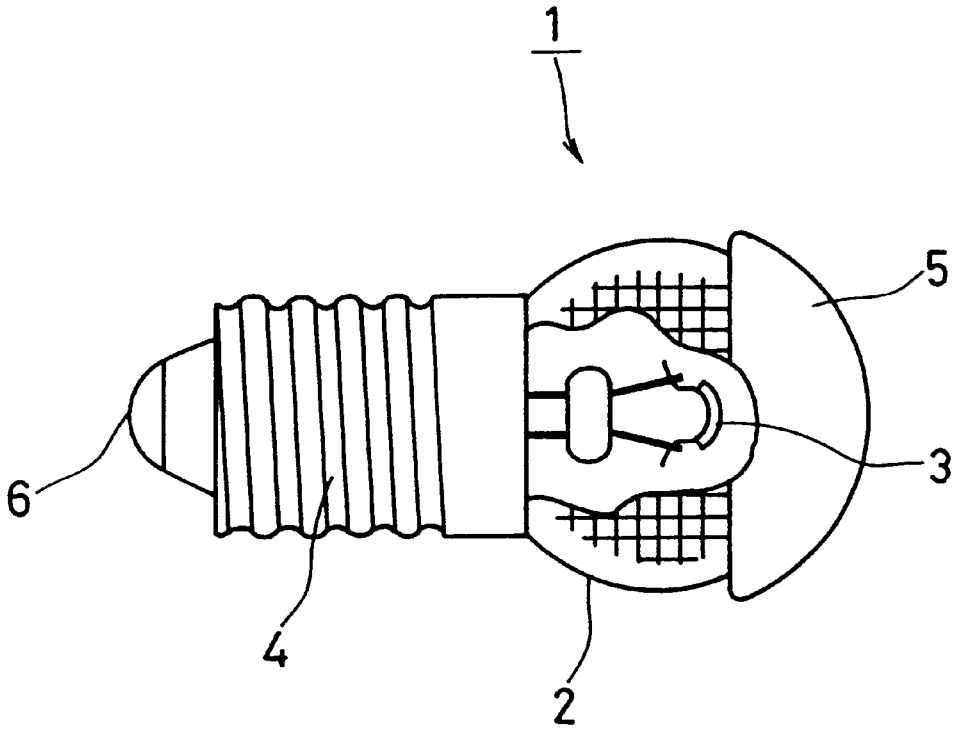
FIG. 1 is a partial cross-sectional view showing a lamp for a bicycle headlight in the first embodiment of this invention.

A lamp for a portable lighting device in this invention has a phosphorescent pigment provided to the front surface of the bulb. Accordingly, the optical energy of the lamp is stored in the phosphorescent pigment arranged at the front surface during the lighting. When the light is turned off, the optical energy stored in the phosphorescent pigment is released. As a result, the lamp remains luminescent for a certain time even if the power supply stops.

A lighting device comprises a lamp with the phosphorescent layer inside (in front of) the reflecting mirror. This configuration prevents much reduction of the illuminance provided ahead due to the phosphorescent pigment at lighting, while increasing the luminescence from outside and inside the phosphorescent pigment by using a reflecting mirror when the light is turned off.

Though commonly-known zinc sulphide (ZnS) can be used for the main component (base) of the phosphorescent pigment used in this invention, strontium aluminate ($SrAl_2O_4$) is used preferably, since strontium aluminate is superior to zinc sulphide in afterglow time (about ten times) and afterglow luminance (about 5 times).

TABLE 1

| Name | Strontium aluminate ($SrAl_2O_4$) | Zinc sulphide (ZnS) |
|---|---|---|
| Excitation Wavelength (nm) | 200–450 | 200–450 |
| Luminescent peak wavelength (nm) | 520 | 530 |
| Afterglow time*[1] (minutes) | 2000 or more | About 200 |
| Afterglow luminance*[2] (cd/m$^2$) | About 2.0 | About 0.4 |

Note:
*[1]Afterglow time is calculated as the time for the afterglow luminance to be decreased to 0.3 mcd/m$^2$ after irradiating with a regular light source $D_{65}$ for five minutes at 1000 lux.
*[2]Afterglow luminance is calculated by irradiating with a regular light source $D_{65}$ for five minutes at 1000 lux and leaving for one minute before measuring the luminance.

The strontium aluminate ($SrAl_2O_4$) can include an activating agent such as europium, cerium, praseodymium, neodymium, samarium, terbium, dysprosium, holmium, erbium, thulium, ytterbium, and lutetium. The ratio of the activating agent to the strontium is from 0.002 to 20 mol %.

Some other fluorescent materials that also can be used in this invention comprises $(SrCaBaMg)_5(PO_4)_3Cl$:Eu; $BaMg_2Al_{16}O_{27}$:Eu; $LaPO_4$:Ce,Th; $MgAl_{11}O_{19}$:Ce,Tb; $Y_2O_2$:Eu; $CaAl_2O_4$:Eu,Tm; and $BaAl_2O_4$:Eu,Tm.

The phosphorescent layer is preferably formed from a phosphorescent compound and a binder resin. The binder resin includes, for example, methacrylic resin, urethane resin, polyolefin resins such as polyethylene and polypropylene, EVA resin, ABS resin, AS resin, polystyrene resin, polycarbonate resin, polyacetal resin, polyester resin, polyamide resin, epoxy resin, phenol resin, urea resin, melamine resin, diallyl phthalate resin, silicon resin, polyimide resin, vinyl resin, polysulfone resin, polyethersulfone resin, cellulose resin, and derivative resins thereof For the polyimide resin, a resin soluble in polar solvents and comprising ether or sulfonic linkage is specifically preferred. Transparent resins are specifically preferable since they do not block light.

Such a phosphorescent layer is formed by, for example, dissolving a binder resin in an appropriate solvent to prepare a solution, adding a phosphorescent compound to this solution and mixing to obtain a paint, and applying the paint to a predetermined part of a lamp. When applying the paint to the front surface of the lamp in the range ¼–½ of the bulb surface area, the front tip of the lamp is dipped in the paint and pulled up to dry-remove the solvent. The thickness of the layer can be adjusted by changing the viscosity of the paint.

The present invention is described in detail below referring to the attached FIGS. 1–7.

(First Embodiment)

FIG. 1 is a partial cross-sectional view showing a lamp for a bicycle headlight in this embodiment. As shown in FIG. 1, 1 is a lamp with 6V of rated voltage and 2.4W of rated power, comprising a single-end bulb 2 whose front surface is provided with a phosphorescent layer 5. Numeral 3 refers to a filament for emitting light, and 4 refers to a base to be inserted into a socket. Numeral 6 refers to a terminal for power supply.

For the phosphorescent layer 5, the above-mentioned strontium aluminate or $SrAl_2O_4$, supplied by Nemoto & Co., Ltd. ("LumiNova") was used. Since this luminescent color agrees well with human visibility, the luminescence is recognized effectively. The phosphorescent layer 5 comprising strontium aluminate ($SrAl_2O_4$) was mixed with a binder resin and a solvent to form a paint, and applied to a predetermined position of a lamp. Subsequently, the solvent was dry-removed, and thus, a phosphorescent layer was formed. For the binder resin, an acrylic urethane resin supplied as S-5010 by Nagashima Special Paint & Co., Ltd. was used. The solvent also was supplied by the same company as a thinner for the S-5010. The thinner includes 20–30 vol. % toluene, 20–30 vol. % methyl isobutyl ketone, 20–30 vol. % cellosolve acetate, 10–20 vol. % ethyl acetate, and 10–20 vol. % butyl acetate. The weight ratio of the blend was as follows. Phosphorescent pigment: binder resin: solvent=100: 8: 10.

The single-end bulb 2 was dipped in the paint and taken out to evaporate the solvent by natural air-drying. The thickness of the applied paint was adjusted by changing the blend ratio of the solvent.

Figure 2:
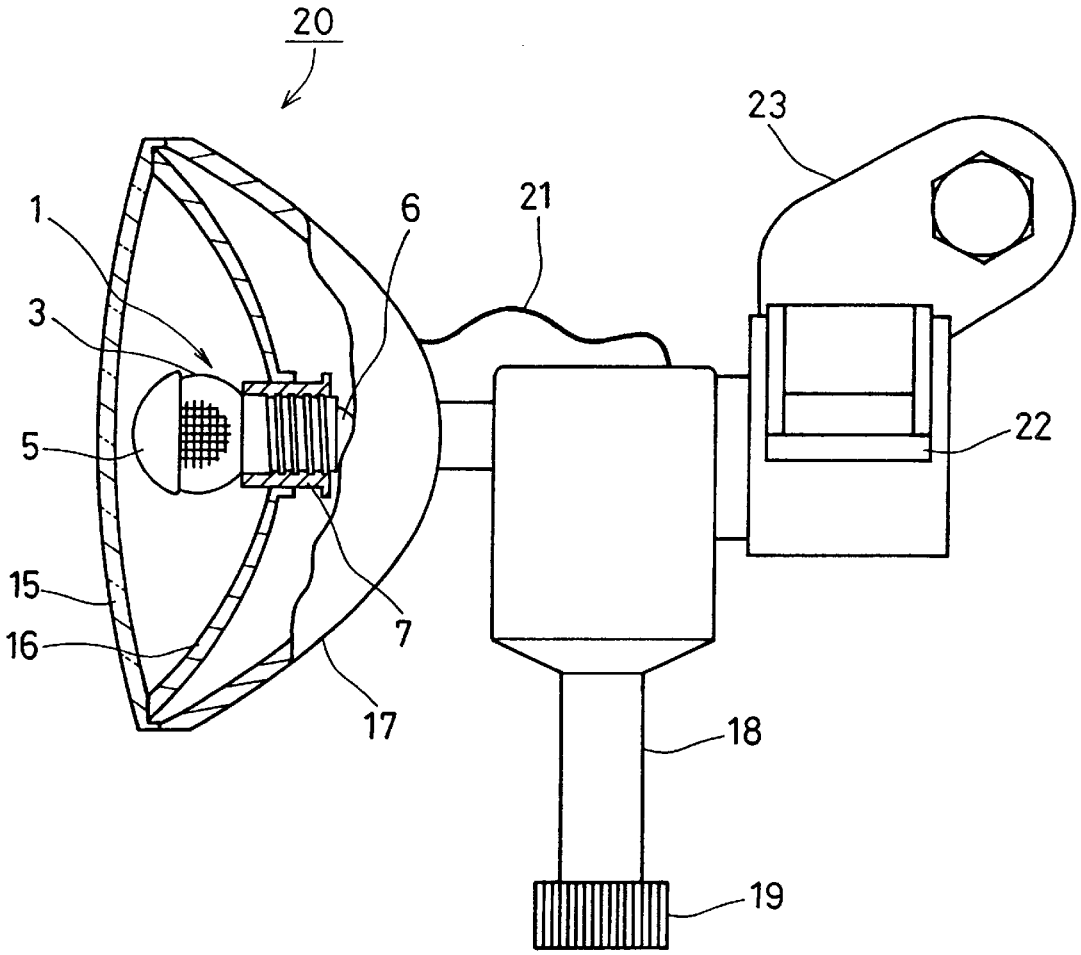
FIG. 2 is a partial cross-sectional view showing the lamp incorporated in a headlight of a bicycle.

FIG. 2 is a partial cross-sectional view showing the lamp 1 incorporated into a bicycle headlight 20. A head case 17 and a lens 15 provide a general outline of the headlight 20. The lamp 1 is fixed in a socket 7 inside a reflecting mirror 16 coaxially. The lamp 1 emits light by alternating current (ac) generated at a motor (not shown) in a dynamo case 18, and throws light ahead of the lens 15. The ac generated at the motor runs through a cord 21, subsequently through the head case 17, the reflecting mirror 16 and the socket 7 before being supplied to the lamp 1. The motor in the dynamo case 18 generates ac by torque of a roller 19 rotating in contact with a tire of the bicycle. The other power terminal 6 of the lamp 1 is located in the bottom, from which the lamp 1 is connected electrically with the bicycle body through the dynamo case 18 and a lamp holder 23. Numeral 22 refers to a lever to contact the roller 19 with the tire.

Figure 3:
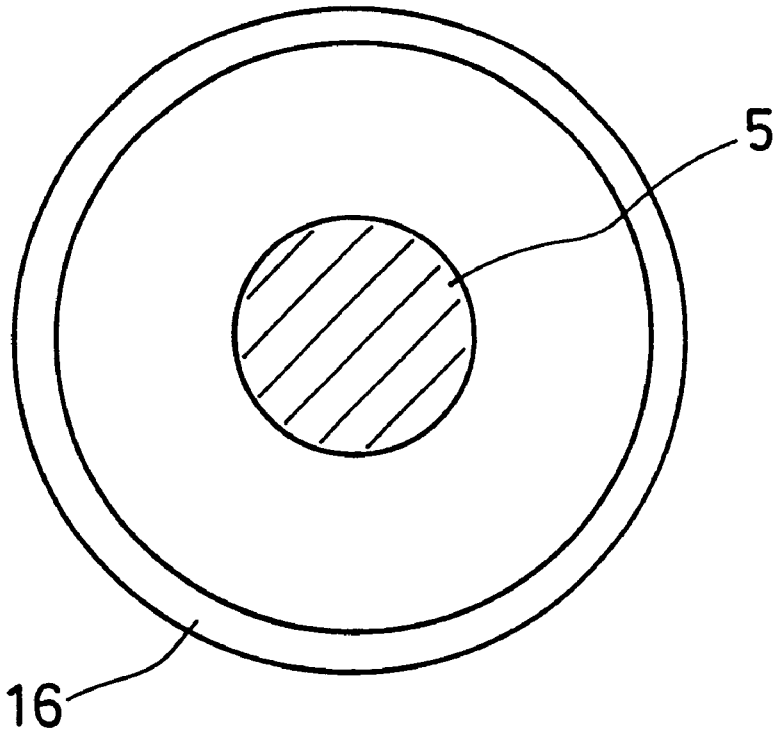
FIG. 3 is a front view showing the lamp of FIG. 2.

FIG. 3 is a front view of the headlight 20 in FIG. 2.

The following explanation is about the luminous intensity that changes depending on the thickness of the applied phosphorescent pigment, and the relationship between the rate of lowering of luminous flux from the lamp and the thickness of the applied phosphorescent pigment.

Figure 4:
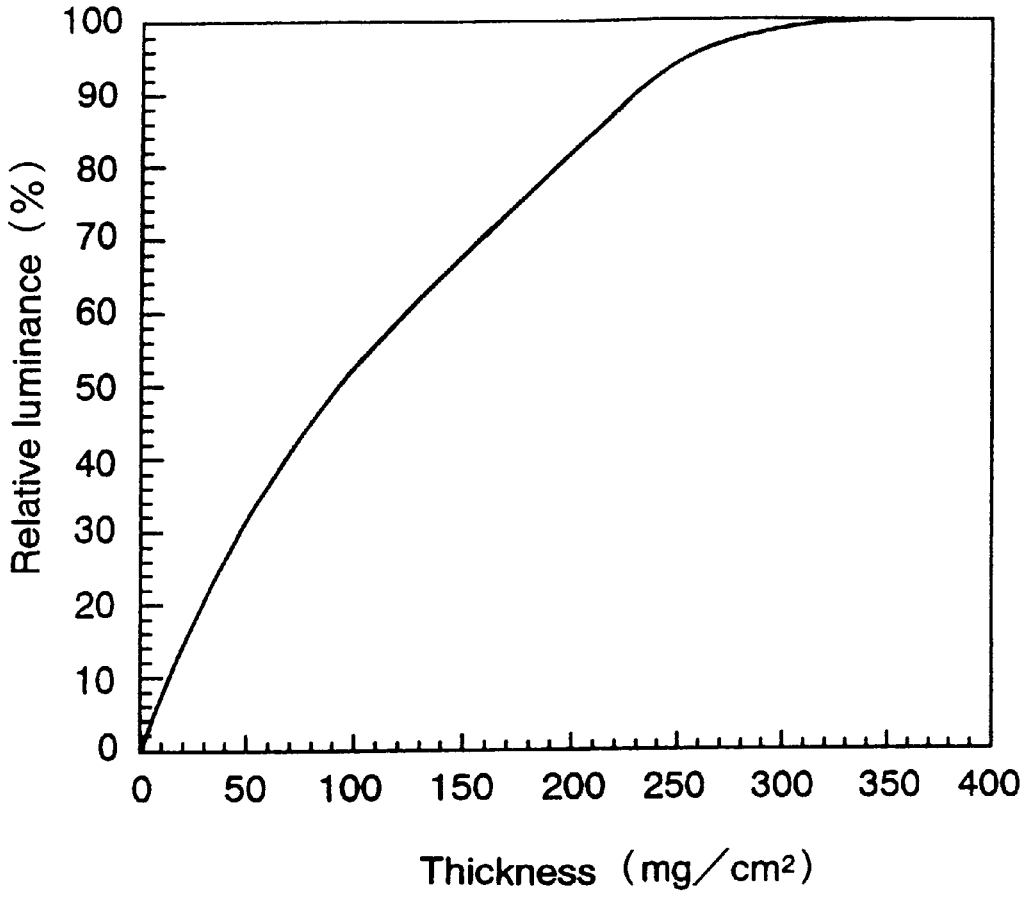
FIG. 4 is a graph showing the relationship between the layer's thickness and the relative luminance.

FIG. 4 shows a relative value of the luminance of a phosphorescent pigment to the thickness of the layer. Though the luminance increased corresponding to the increasing thickness of the layer to some degree, it topped out at a certain level. This fact indicates that an excessively-thick layer will not improve the luminescent property. If a thick layer is applied, the transmission rate of the light from the light source is lowered, which will cause an adverse effect for lighting. The thickness of the phosphorescent layer 5 applied to the lamp 1 should be selected properly.

In this embodiment, the solvent was controlled to apply about a 150–250 mg/cm$^2$-thick phosphorescent layer 5. The phosphorescent layer 5 was applied to the front surface of the single-end bulb 2 to cover half the bulb surface area.

This embodiment will be explained further referring to FIGS. 5(*a*) and 5(*b*). The lighting device in FIGS. 5(*a*) and 5(*b*) is identical to that of FIG. 1, as the details are omitted for convenience.

Figure 5A:
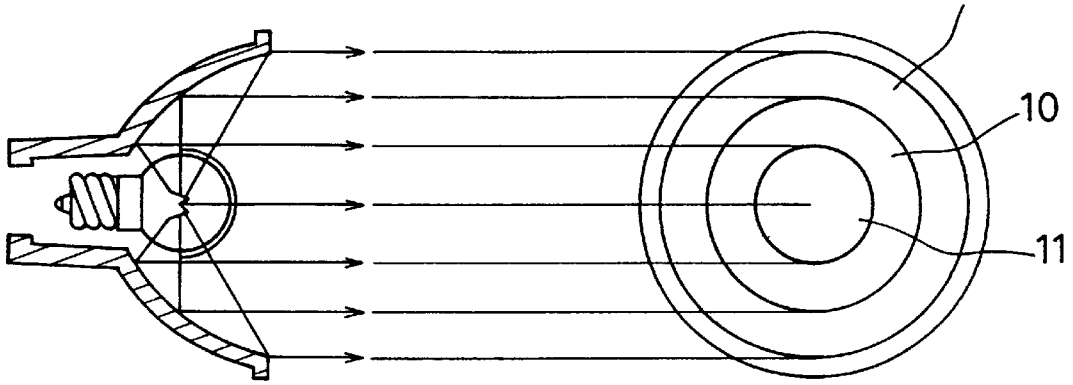
Figure 5B:
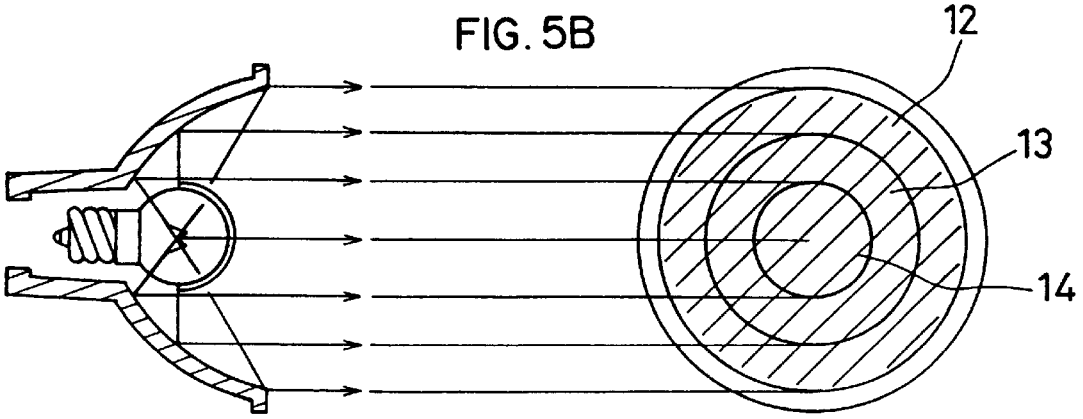

FIG. 5(*a*) shows the light paths and a front view of the reflecting mirror 16 at lighting, while FIG. 5(*b*) shows the same light paths and the same lamp just after turning off the light. In the lighting of the lamp, the light emitted from the filament 3 is divided into direct light and transmitted light passing through the phosphorescent layer 5. The transmitted light passing through the phosphorescent layer 5 includes a direct light beam 11 and a reflected light beam 9, while the direct light not passing through the phosphorescent layer 5 includes a reflected light beam 10 that is obtained from the filament 3 through the reflecting mirror 16. Most of the light beams emitted forward include the reflected light beam 10 coming from the filament 3 without passing through the phosphorescent layer 5. The light beam passing through the phosphorescent layer 5 is determined appropriately based on the thickness of the same layer 5 considering the luminous property and light transmission.

As a result, the total illuminance was not sacrificed considerably, and the lighting device was used without any substantial difficulties.

The condition just after turning off the light is explained below referring to FIG. 5(*b*). The light from the phosphorescent layer 5 comprises a light beam 14 from the outer surface of the same layer 5, a light beam 12 from the reflecting mirror 16, and a light beam 13 coming from the inner surface of the same layer 5 to the reflecting mirror 16, and then irradiated ahead of the reflecting mirror 16.

In a front view of the reflecting mirror 16, the whole body of the reflecting mirror 16 appears to illuminate, which can enhance the recognizability considerably.

FIG. 6 illustrates a comparison of results obtained by changing the application range and position of the phosphorescent layer 5. If the thickness and area of the phosphorescent layer 5 do not change, the illuminance varies substantially depending on the application position. When more direct light from the filament 3 is irradiated ahead by the reflecting mirror 16, the illuminance is increased. As a result, the phosphorescent layer 5 is preferably applied to the front part of the reflecting mirror 16 since the direct light from the filament 3 to the reflecting mirror 16 is less hindered.

In a general judgement based on some factors such as luminous flux, illuminance and luminescent recognizability of the phosphorescent layer 5 just after turning off the light, the most effective application range of the phosphorescent layer 5 is from ¼ to ½ of the surface area of a single-end bulb, when the phosphorescent layer 5 is applied to the front part of the same bulb.

The phosphorescent layer 5 on the lamp of this embodiment was not peeled off even when it was touched by someone for carrying or fixed in a socket. Therefore, the lamp of this embodiment was useful for a portable lighting device.

(Second Embodiment)

Figure 7:
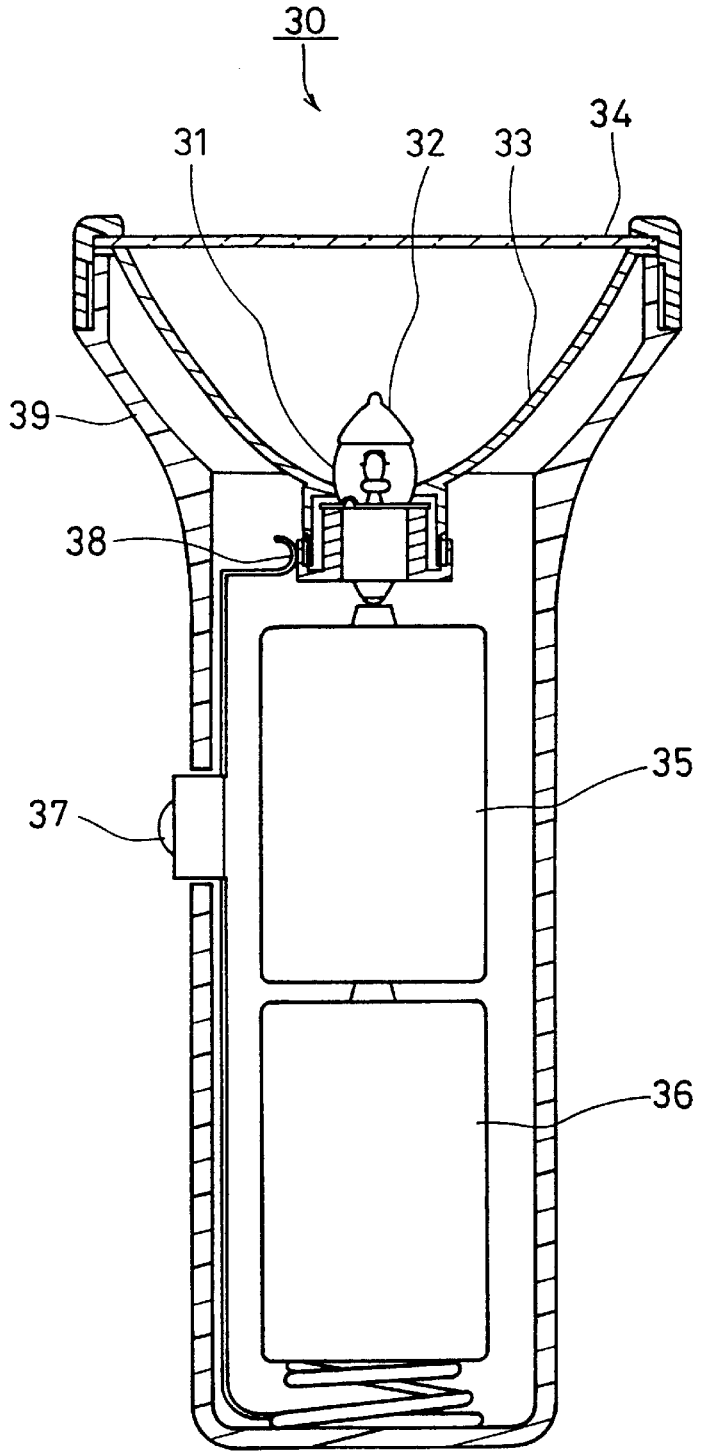
FIG. 7 is a cross-sectional view showing a flashlight used for emergencies or for disasters (an emergency flashlight).

FIG. 7 shows an emergency flashlamp 30 comprising a lamp of this invention. In FIG. 7, a lamp 31 has 2.4 V of rated voltage and 0.38 A of rated current, and it comprises a phosphorescent layer 32 formed on the top outer surface of a single-end bulb. The bulb is provided inside the reflecting mirror 33 coaxially. The phosphorescent layer 32 was formed in the same way as the First Embodiment. The lighting part of the flashlight 30 comprises the reflecting mirror 33 and a front glass 34. In a casing 39, for example, two size D batteries (35, 36) are provided with positive electrodes contacting constantly with the bottom terminal of the lamp 31. When lighting, a terminal 38 contacts with the socket by flipping on a switch 37, and conducts electrically with the base of the lamp.

The emergency flashlight 30 usually may be located, for example, in a room corner, with the lamp 1 directed upward. If the lamp 1 is positioned upward, sunshine impinges either directly or indirectly on the phosphorescent layer 32 in the daytime. Some light will impinge even at night. When power fails for some reasons such as a disaster and causes a total darkness, the phosphorescent layer 32 illuminates to indicate the location of the flashlight 30. As a result, the flashlight 30 can be used for safe evacuation or the like.

The phosphorescent pigment on the lamp of this embodiment was not peeled off even when it was touched by someone for carrying or fixed in a socket. Therefore, the lamp of this embodiment was useful for a portable lighting device.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A portable lighting device comprising a lamp comprising a bulb provided with a phosphorescent layer on at least a front surface of the bulb, wherein the phosphorescent layer comprises a phosphorescent compound and a binder resin and the phosphorescent layer covers the bulb surface only in the range from ¼ to ½, the lamp being disposed inside a reflecting mirror.

2. The portable lighting device according to claim 1, wherein the binder resin is included in the range from 1 to 50 weight parts to 100 weight parts of the phosphorescent compound.

3. The portable lighting device according to claim 1, wherein the thickness of the phosphorescent layer ranges from 150 $mg/cm^2$ to 250 $mg/cm^2$.

4. The portable lighting device according to claim 1, wherein the phosphorescent compound is an inorganic material whose luminescent peak is in a wavelength of about 350 nm to 700 nm.

5. The portable lighting device according to claim 1, wherein the phosphorescent compound comprises strontium aluminate ($SrAl_2O_4$) as a main component.

6. The portable lighting device according to claim 1, selected from the group consisting of a flashlight, a headlight for a bicycle, and a head lamp.

* * * * *